US008398189B2

(12) United States Patent
Nishida

(10) Patent No.: US 8,398,189 B2
(45) Date of Patent: Mar. 19, 2013

(54) LIQUID DISCHARGE APPARATUS

(75) Inventor: Katsunori Nishida, Aichi-ken (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 256 days.

(21) Appl. No.: 12/868,316

(22) Filed: Aug. 25, 2010

(65) Prior Publication Data

US 2011/0050765 A1 Mar. 3, 2011

(30) Foreign Application Priority Data

Aug. 31, 2009 (JP) ..... 2009-199358

(51) Int. Cl.
*B41J 29/38* (2006.01)
*B41J 2/175* (2006.01)

(52) U.S. Cl. ..... 347/6; 347/85

(58) Field of Classification Search ..... 347/6, 7, 347/20, 29, 35, 85, 86
See application file for complete search history.

(56) References Cited

U.S. PATENT DOCUMENTS

| | | | |
|---|---|---|---|
| 5,216,450 | A | 6/1993 | Koitabashi et al. |
| 6,142,600 | A | 11/2000 | Takahashi et al. |
| 7,926,905 | B2 | 4/2011 | Toki et al. |
| 2007/0132802 | A1 | 6/2007 | Ouchi |
| 2008/0231659 | A1 | 9/2008 | Toki et al. |
| 2009/0141106 | A1 | 6/2009 | Takagi |

FOREIGN PATENT DOCUMENTS

| | | | |
|---|---|---|---|
| JP | 03-136867 | A | 6/1991 |
| JP | 07-195708 | A | 8/1995 |
| JP | 08-039824 | A | 2/1996 |
| JP | 10-6527 | | 1/1998 |
| JP | 2001-322290 | A | 11/2001 |
| JP | 2002-192750 | A | 7/2002 |
| JP | 2002-240320 | | 8/2002 |
| JP | 2006-035786 | A | 2/2006 |
| JP | 2007-152914 | | 6/2007 |
| JP | 2009-132120 | | 6/2009 |

OTHER PUBLICATIONS

Japanese Official Action dated Jan. 22, 2013, from related application JP 2009-199358.

*Primary Examiner* — An Do
(74) *Attorney, Agent, or Firm* — Scully, Scott, Murphy & Presser, P.C.

(57) ABSTRACT

A liquid discharge apparatus is provided, including a cartridge attaching section to which a first liquid cartridge and a second liquid cartridge smaller than the first liquid cartridge are selectively attached, a liquid discharge head having a plurality of nozzles and a plurality of driving sections individually corresponding to the nozzles, a purge mechanism which performs a purge operation, and a purge control unit which allows the purge mechanism to perform the purge operation so that a forcible ink discharge amount in a period of time in a case in which the first liquid cartridge is attached to the cartridge attaching section is smaller than a forcible ink discharge amount in a period of time in a case in which the second liquid cartridge is attached.

15 Claims, 8 Drawing Sheets

R1 > R2 > R3

LIQUID DISCHARGE APPARATUS

CROSS REFERENCE TO RELATED APPLICATION

The present application claims priority from Japanese Patent Application No. 2009-199358, filed on Aug. 31, 2009, the disclosure of which is incorporated herein by reference in its entirety.

BACKGROUND OF THE INVENTION

1. Field of the Invention

The present invention relates to a liquid discharge apparatus including a purge mechanism which is configured to forcibly discharge bubbles and viscosity-increased inks contained in a liquid discharge head.

2. Description of the Related Art

An ink discharge apparatus of an ink-jet printer is known as an example of the conventional liquid discharge apparatus. In general, the ink discharge apparatus is provided with an ink-jet head having a plurality of nozzles through which inks are discharged and a plurality of driving sections which are provided corresponding to the plurality of nozzles respectively. When the printing is performed, the inks are discharged from the respective nozzles toward the printing paper by selectively operating the respective driving sections. On the other hand, when the maintenance is performed, then a nozzle cap is installed to a nozzle surface of the ink-jet head, and then the air contained in the nozzle cap is sucked by a suction pump. Accordingly, the bubbles and the viscosity-increased inks, which are contained in the ink-jet head, are forcibly discharged from the nozzles. The process or treatment, in which the viscosity-increased inks and the bubbles are forcibly discharged, is generally referred to as "purge".

SUMMARY OF THE INVENTION

In recent years, in response to the needs of the users who expect, for example, the mitigation of the time and labor required for the exchange of ink cartridges, an ink cartridge, which has an initial volume extremely larger than those for the inks of other colors, is provided for the ink of a certain color. A system is conceived for an ink jet printer, in which an ink cartridge having a standard volume and an ink cartridge having a large volume can be selectively attached. In the case of such an ink jet printer, the following situation arises. That is, the ink of a certain color is supplied from the large volume ink cartridge, and the ink of the other color is supplied from the standard volume ink cartridge.

In such a situation, the present inventors have recognized the following problem. That is, regarding the ink supplied from the ink cartridge having the large volume and the ink supplied from the ink cartridge having the standard volume, if the purge is performed under the same condition, then the amount of forcible discharge of the ink supplied from the ink cartridge having the large volume is unnecessarily increased, and any useless consumption arises in the ink of this color.

As a result of diligent investigations performed by the present inventor, it has been found out that the speed of increase in viscosity of the ink is quickened when the initial volume of the ink cartridge is small, as compared with when the initial volume is large. Further, the present inventor has found out the following fact. That is, those considered as the cause or factor of the occurrence of the phenomenon as described above are the increase in the ratio of the "area of the liquid surface of the ink in the ink cartridge" with respect to the "amount of the accommodated ink" (ratio of the "area of the concerning ink brought in contact with the gas portion (atmospheric air) in the ink cartridge" with respect to the "amount of the accommodated ink"), and the increase in the ratio of the "opening area of the atmospheric air communication hole provided for the ink cartridge" with respect to the "amount of the accommodated ink", and these increases in the ratios are caused when the initial volume of the ink cartridge is small, as compared with when the initial volume is large. The knowledge of the present inventor will now be explained in detail. In the ink cartridge, the volatile components such as the water content of the ink and the like are vaporized into the atmospheric air via the liquid surface of the ink (interface between the ink and the atmospheric air). Further, the volatile components outgo to the outside of the ink cartridge via the atmospheric air communication hole. Therefore, it is considered that the amount of vaporization and the speed of vaporization of the ink are correlated with the area or areal size of the liquid surface of the ink and the opening area or areal size of the atmospheric air communication hole of the ink cartridge. If it is assumed that a certain amount of the viscosity-increased ink appears resulting from the vaporization of the ink, and the viscosity-increased ink is diffused to the entire ink, then it is considered that the viscosity of the entire ink is increased or raised more easily when the initial volume is small as compared with when the initial volume is large.

On the basis of this knowledge of the present inventor, the present inventor has found out the following problem to be caused when the ink cartridge having the standard volume and the ink cartridge having the large volume are attached. That is, any difference arises in the speed of the increase in viscosity of the ink between the ink cartridge having the standard volume and the ink cartridge having the large volume. Therefore, for example, if the amount of ink discharge, which is to be provided by the purge, is determined on the basis of the ink cartridge having the standard volume, then the amount of ink discharge is unnecessarily increased for the ink of the color for which the ink cartridge having the large volume with the slow speed of increase in viscosity is attached, and thus the ink is uselessly consumed frequently.

The present invention has been made in order to solve the problem as described above, an object of which is to provide a liquid discharge apparatus which makes it possible to properly determine the ink waste amount to be brought about by the purge in relation to each of liquid cartridges and which makes it possible to suppress any useless consumption of liquids in the purge operation even in such an environment that a plurality of types of liquid cartridges having different initial volumes are used.

According to an aspect of the present invention, there is provided a liquid discharge apparatus which discharges a liquid accommodated in a liquid cartridge, including:

a cartridge attaching section to which the liquid cartridge is attached, the liquid cartridge being one of a first liquid cartridge belonging to a first size class and a second liquid cartridge belonging to a second size class smaller than the first size class;

a liquid discharge head which is formed with a plurality of nozzles to be communicated with the liquid cartridge under a condition that the liquid cartridge is attached to the cartridge attaching section, the liquid discharge head having a plurality of driving sections which correspond to the nozzles and which causes the liquid to be discharged from the nozzles;

a purge mechanism which performs a purge operation in which the liquid is discharged forcibly from the nozzles; and a purge control unit which controls the purge mechanism to perform the purge operation so that a forcible ink discharge amount in a period of time in a case in which the first liquid cartridge belonging to the first size class is attached to the cartridge attaching section is smaller than a forcible ink discharge amount in a period of time in a case in which the second liquid cartridge belonging to the second size class is attached to the cartridge attaching section.

In general, as for the initial volume of the liquid cartridge, the larger the size of the contour (outer shape) of the liquid cartridge (hereinafter simply referred to as "size") is, the larger the volume is. The smaller the size is, the smaller the volume is. Therefore, it is considered that a correlation exists between the size of the liquid cartridge and the initial volume. The forcible ink discharge amount (referred to herein as "total purge amount"), which is provided in a period of time, is decreased when the size of the liquid cartridge belongs to the first size class (for example, "large size class") as compared with when the size of the liquid cartridge belongs to the second size class (for example, "small size class" or "middle size class") which is smaller than the first size class. The information, which relates to the size of each of the liquid cartridges, may be obtained, for example, by detecting the size of the liquid cartridge. Alternatively, it may be previously determined that two or more types of the liquid cartridges having different sizes are to be attached, and the information, which relates to the size of each of the liquid cartridges, may be recognized.

According to the liquid discharge apparatus of the present invention, the "total purge amount", which relates to the liquid cartridge, is adjusted on the basis of the size of the liquid cartridge. Therefore, it is unnecessary to provide any complicated detecting apparatus for detecting the initial volume. The liquid discharge apparatus can be produced easily and inexpensively. Further, it is unnecessary to provide any structure for monitoring the remaining amount of the liquid, as compared with a case in which the total purge amount is adjusted depending on the remaining amount while monitoring the remaining amount of the liquid contained in the cartridge. Further, the control is not complicated as well. Even in such an environment that a plurality of types of the liquid cartridges, which have different initial volumes, are used, the "total purge amount" in relation to each of the liquid cartridges can be property adjusted on the basis of the size (i.e., the initial volume) of each of the liquid cartridges. It is possible to suppress any useless consumption of the liquid in the purge operation.

DESCRIPTION OF THE PREFERRED EMBODIMENTS

An explanation will be made below with reference to the drawings about a "liquid discharge apparatus" according to an embodiment of the present teaching. The "downward direction" described in the following explanation means the direction in which the inks are discharged, and the "upward direction" means the direction which is opposite thereto.

First Embodiment

Figure 1:
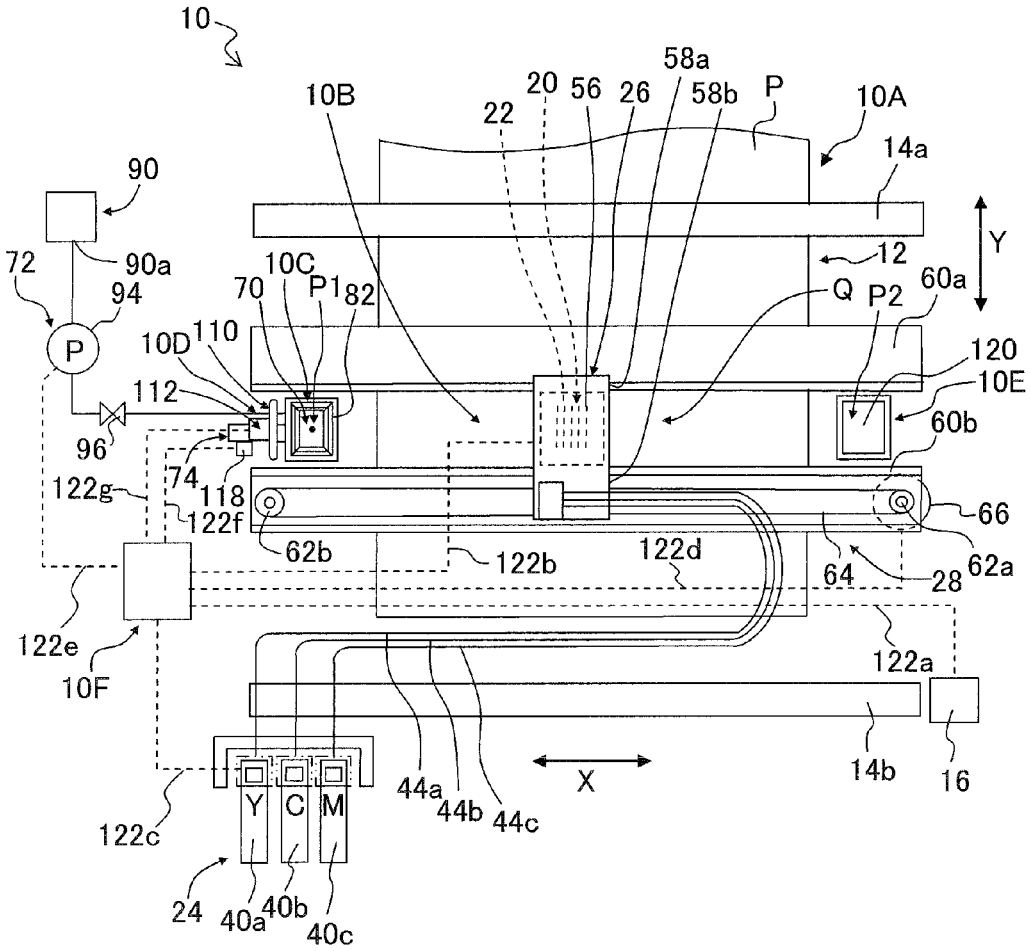
FIG. 1 shows a plan view illustrating an arrangement of an ink discharge apparatus according to a first embodiment.

As shown in FIG. 1, the ink discharge apparatus 10 according to the first embodiment includes a printing paper transport unit 10A which transports the printing paper P as a "discharge objective" to the printing area Q, a printing unit 10B which prints an image on the printing paper P transported to the printing area Q, a purge unit 10C which is provided to execute the "purge operation", a wipe unit 10D which is provided to execute the "wipe operation", a flashing unit 10E which is provided to execute the "color mixture-preventive flashing operation", and a control unit 10F which controls the components described above. The arrangement of these components will be specifically explained below.

As shown in FIG. 1, the printing paper transport unit 10A has a transport route (passage) 12 which guides the printing paper P to the printing area Q, an upstream transport roller 14*a* which is arranged on the upstream side in the transport route 12 as compared with the printing area Q, a downstream transport roller 14*b* which is arranged on the downstream side in the transport route 12 as compared with the printing area Q, and a driving motor 16 which rotates the transport rollers 14*a*, 14*b*. When the transport rollers 14*a*, 14*b* are rotated by the driving motor 16, and the printing paper P is transported to the printing area Q, then the printing paper P is positioned under or below the printing unit 10B, and the printing can be performed on the printing paper P. In the following description, the transport direction of the printing paper P is referred to as "subsidiary scanning direction Y", and the direction, which is perpendicular to the subsidiary scanning direction Y, is referred to as "main scanning direction X".

As shown in FIG. 1, the printing unit 10B has an ink-jet head 20, an ink supply section 24 which supplies the inks to the ink-jet head 20, a carriage 26 which carries the ink-jet head 20, and a scanning section 28 which reciprocatively moves the carriage 26.

Figure 2:
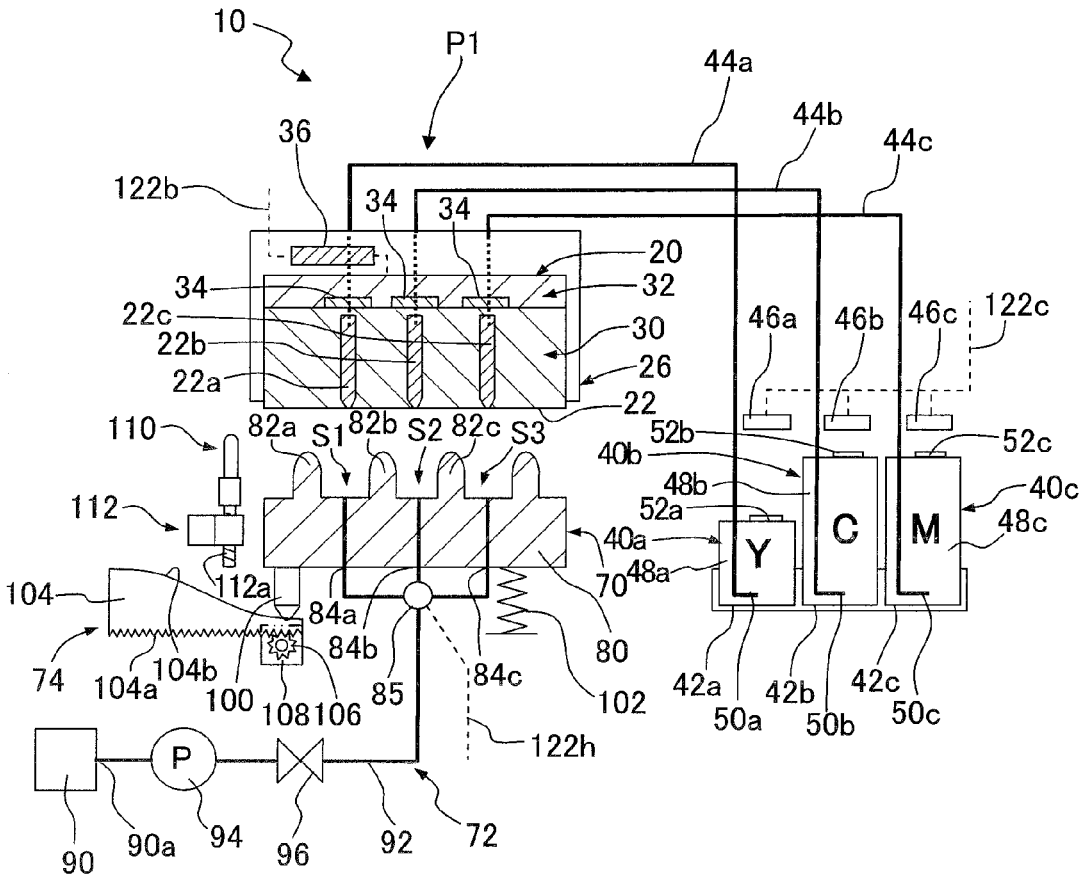
FIG. 2 shows a sectional view illustrating the arrangement of the ink discharge apparatus according to the first embodiment.

As shown in FIG. 2, the ink-jet head 20 has a channel unit 30 which has a nozzle surface 22 formed with nozzles 22*a*, 22*b*, 22*c*, and a driving unit 32 which is joined to the channel unit 30. The channel unit 30 has a plurality of manifolds (not shown) which accommodate the inks and which are classified in accordance with the respective colors. Each of the nozzles 22*a*, 22*b*, 22*c* for discharging the inks is communicated with one of the manifolds. In other words, the nozzles 22*a* are communicated with the manifold for accommodating the yellow (Y) ink, the nozzles 22*b* are communicated with the manifold for accommodating the cyan (C) ink, and the nozzles 22*c* are communicated with the manifold for accommodating the magenta (M) ink. The "number of the colors" and the "types of the colors" of the inks are not specifically limited. It is also allowable to use the inks of two colors or four or more colors. It is also allowable to use the black (BK) ink. The number of the nozzles 22*a*, which are communicated with the manifold for accommodating the yellow (Y) ink, may be one. In this case, the manifold may be omitted. This arrangement may be also applicable to the nozzles 22*b*, 22*c* in the same manner as described above.

The driving unit 32 has a plurality of driving sections 34 which individually correspond to the nozzles 22*a*, 22*b*, 22*c* respectively. The control unit 10F (FIG. 1) is electrically connected to the driving unit 32 via a driver IC 36. When the control signal is applied from the control unit 10F to the driver IC 36, the driving signal is applied from the driver IC 36 to the respective driving sections 34. The inks are selectively discharged from the nozzles 22*a*, 22*b*, 22*c* corresponding to the respective driving sections 34. In this arrangement, each of the driving sections 34 is composed of a piezoelectric actuator which has a piezoelectric layer formed of a piezoelectric material such as PZT or the like and a pair of electrodes arranged to interpose the piezoelectric layer therebetween. However, in the current teaching, it is not necessarily indispensable that each of the driving sections 34 should be composed of the piezoelectric actuator. It is also possible to adopt, for example, a driving section of the so-called bubble jet system having a heater for converting the electric power of the driving signal applied from the driver IC 36 into the heat.

As shown in FIG. 2, the ink supply section 24 has three ink cartridges 40*a*, 40*b*, 40*c* which accommodate the inks of the three colors of yellow (Y), cyan (C), and magenta (M), cartridge attaching sections 42*a*, 42*b*, 42*c* (individual cartridge attaching sections) to which the ink cartridges 40*a*, 40*b*, 40*c* are detachably attached, three ink tubes 44*a*, 44*b*, 44*c* through which the respective inks contained in the ink cartridges 40*a*, 40*b*, 40*c* are supplied to the corresponding nozzles 22*a*, 22*b*, 22*c* of the channel unit 30 (FIG. 2), and size detecting sections 46*a*, 46*b*, 46*c* which detect the sizes of the ink cartridges 40*a*, 40*b*, 40*c*.

The ink cartridges 40*a*, 40*b*, 40*c* have substantially cuboid-shaped container bodies 48*a*, 48*b*, 48*c* respectively. Ink outlets 50*a*, 50*b*, 50*c*, with which the ink tubes 44*a*, 44*b*, 44*c* are communicated, are formed on the lower side surfaces of the container bodies 48*a*, 48*b*, 48*c*. Indicators (markers) 52*a*, 52*b*, 52*c*, which are, for example, bar codes including the "information about the size", are affixed to the upper surfaces of the container bodies 48*a*, 48*b*, 48*c* by means of, for example, the printing of the indicators or the sticking a seal of the indicators. The size detecting sections 46*a*, 46*b*, 46*c*, which are, for example, optical sensors that detect the sizes of the ink cartridges by reading the "information about the size" from the indicators 52, 52*b*, 53*c*, are arranged over or above the ink cartridges 40*a*, 40*b*, 40*c*.

The "information about the size", which is included in each of the indicators 52*a*, 52*b*, 52*c*, is the information to indicate any one of the size classes of "small", "middle", and "large" to which the size of each of the ink cartridges 40*a*, 40*b*, 40*c* belongs. The information indirectly indicates any one of "small volume", "middle volume", and "large volume" to which the initial volume of each of the ink cartridges 40*a*, 40*b*, 40*c* belongs. Therefore, the size detecting sections 46*a*, 46*b*, 46*c* can indirectly read the initial volumes by detecting the sizes of the ink cartridges 40*a*, 40*b*, 40*c* from the indicators 52*a*, 52*b*, 52*c*.

The size detecting sections 46*a*, 46*b*, 46*c* may be constructed such that projections, which are formed at different positions depending on the respective sizes, are detected or sensed mechanically to detect the sizes thereby. Alternatively, the size detecting sections 46*a*, 46*b*, 46*c* may be constructed such that the outer shapes or contours of the ink cartridges 40*a*, 40*b*, 40*c* are detected or sensed optically or mechanically to detect the sizes thereby.

The ink cartridges 40*a*, 40*b*, 40*c* are attached to the cartridge attaching sections 42*a*, 42*b*, 42*c* respectively. In this embodiment, three types of the ink cartridges 40*a* having different sizes ("large", "middle", and "small") may be attached to the cartridge attaching section 42*a* corresponding to the yellow ink. Similarly, three types of the ink cartridges 40*b*, 40*c* having different sizes may be also attached to the cartridge attaching sections 42*b*, 42*c* respectively. The cartridge attaching sections 42*a*, 42*b*, 42*c* are formed so that the bottom surfaces of the ink cartridges 40*a*, 40*b*, 40*c* have the same height, even when the ink cartridges 40*a*, 40*b*, 40*c* of any sizes are attached. Further, the cartridge attaching sections 42*a*, 42*b*, 42*c* are formed so that the initial liquid surface heights, which are provided in the ink cartridges 40*a*, 40*b*, 40*c* respectively, are lower than the heights of the discharge ports of the nozzles 22*a*, 22*b*, 22*c*, even when the ink cartridges 40*a*, 40*b*, 40*c* having the largest size, i.e., "large" ink cartridges 40*a*, 40*b*, 40*c* are attached to the cartridge attaching sections 42*a*, 42*b*, 42*c*.

Figure 3A:
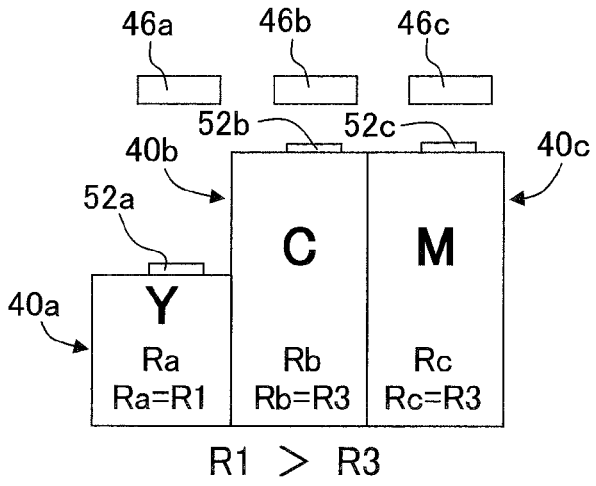
FIGS. 3A, 3B and 3C show the "total purge amount" for each of the sizes of ink cartridges (for different colors) respectively.
Figure 3B:
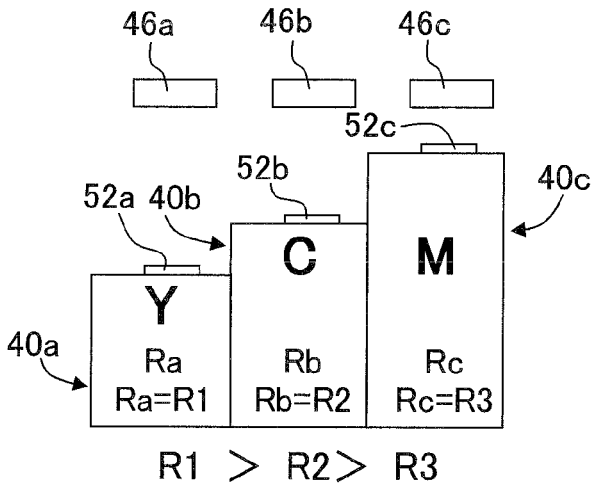
Figure 3C:
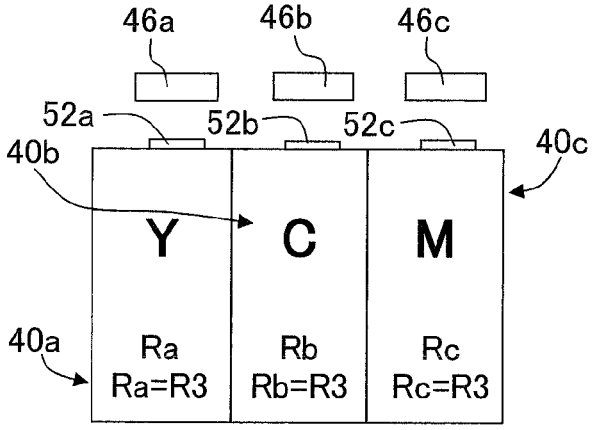

In this embodiment, as shown in FIGS. 2 and 3A, the ink cartridge 40*a* for the yellow (Y) has the "small" size, the ink cartridge 40*b* for the cyan (C) has the "large" size, and the ink cartridge 40*c* for the magenta (M) has the large "large" size. However, the sizes can be appropriately changed. For example, as shown in FIG. 3B, the sizes of the ink cartridges 40*a*, 40*b*, 40*c* may be "small", "middle", and "large" respectively. As shown in FIG. 3C, all of the sizes of the ink cartridges 40*a*, 40*b*, 40*c* may be identical with each other. Further, the selectable type of the size (or the selectable types of the sizes) of the ink cartridges 40*a*, 40*b*, 40*c*, which is/are, for example, "extra-large (extremely large)" and/or "infinitely small (extremely small)", may be added. On the contrary, the types of the sizes of the ink cartridges 40*a*, 40*b*, 40*c* may be two.

In this embodiment, the initial volumes of the ink cartridges having the respective sizes of "large", "middle", and "small" are 3.5 cc, 7.0 cc, and 10.5 cc respectively. In any case, the size or dimension of the bottom surface (bottom surface shape) of each of the ink cartridges is identical irrelevant to the size of the ink cartridge. In other words, the sizes or dimensions of the width and the depth are the same irrelevant to the size of the ink cartridge. The difference in the size of the ink cartridge results from the height of the ink cartridge. For example, the ink cartridge having the "middle" size is higher than the ink cartridge having the "small" size by about 20 mm. Further, the ink cartridge having the "large" size is higher than the ink cartridge having the "middle" size by about 20 mm. In the present teaching, it is not necessarily indispensable that the ink cartridges having the different sizes should have any common bottom surface shape. However, in this embodiment, the common bottom surface shape is provided for the ink cartridges having the different sizes. Therefore, the ink cartridges having the different sizes can be attached even when no special artifice is applied to the cartridge attaching section.

As shown in FIG. 1, the carriage 26 is a substantially cuboid-shaped member which elongates in the subsidiary scanning direction Y. The carriage 26 has a holder section 56 which holds the ink-jet head 20, and sliding sections 58*a*, 58*b* which are formed integrally with the holder section 56 and which are slidably attached to guide rails 60*a*, 60*b* respectively as described later on.

As shown in FIG. 1, the scanning section 28 reciprocatively moves the ink-jet head 20 together with the carriage 26 in the main scanning direction X. The scanning section 28 has the two lengthy plate-shaped guide rails 60*a*, 60*b* which guide the carriage 26, a driving pulley 62*a* which is provided at one end portion in the longitudinal direction of the guide rail 60*b*, a driven pulley 62*b* which is provided at the other end portion in the longitudinal direction of the guide rail 60*b*, an annular or ring-shaped driving belt 64 which is applied to travel between the driving pulley 62*a* and the driven pulley 62*b*, and a driving motor 66 which rotates the driving pulley 62*a*. The carriage 26 is fixed to the driving belt 64. In this embodiment, the "home position P1", at which the purge unit 10C is arranged, is positioned on one side of the transport route 12 in the main scanning direction X, and the "flashing position P2", at which the flashing unit 10E is arranged, is positioned on the other side of the transport route 12. The scanning section 28 is constructed so that the ink jet head 20 is reciprocatively movable at least between the "home position P1" and the "flashing position P2".

The printing unit 10B of this embodiment is applied to the so-called "serial type printer". However, in place thereof, it is also allowable to adopt the "line type printer" in which the printing is performed while moving the printing paper P with respect to a fixed ink jet head.

As shown in FIG. 2, the purge unit 10C is provided with a nozzle cap 70 which covers the nozzle surface 22 of the ink-jet head 20 when the carriage 26 stops, a sucking section 72 which is provided as the "purge mechanism" to forcibly discharge the inks from the nozzles 22*a*, 22*b*, 22*c* corresponding to the ink cartridges 40*a*, 40*b*, 40*c*, a cap operating section 74 which installs the nozzle cap 70 to the nozzle surface 22 or which separates or disengages the nozzle cap 70 from the nozzle surface 22, and the control unit 10F which is provided as the "purge control unit".

The nozzle cap 70 has a plate-shaped cap body 80 which has a substantially rectangular shape as viewed in a plan view and which is positioned opposingly to the nozzle surface 22 of the ink-jet head 20, a lip 82*a* which rises from the upper surface of the outer circumferential portion of the cap body 80 and which is formed in an annular form, and lips 82*b*, 82*c* which partition the inner space of the lip 82*a* into three cap spaces S1, S2, S3 corresponding to the nozzles 22*a*, 22*b*, 22*c* respectively. Accordingly, the individual cap sections, which individually cover the nozzles 22*a*, 22*b*, 22*c* respectively, are formed for the nozzle cap 70. Three discharge holes 84*a*, 84*b*, 84*c* are formed through the cap body 80 corresponding to the cap spaces S1, S2, S3 respectively.

The sucking section 72 includes: a waste ink tank 90; a changeover valve (switching valve or selector valve) 85 which switches the discharge route into three ways; a waste ink channel 92 which communicates an inlet 90*a* of the waste ink tank 90 with the discharge holes 84*a*, 84*b*, 84*c* respectively via the changeover valve 85; a suction pump 94 which is provided on the downstream side from the changeover valve 85 disposed at the intermediate position of the waste ink channel 92; and a shut off valve 96 which is provided on the upstream side from the suction pump 94 disposed at the intermediate position of the waste ink channel 92 and which is provided on the downstream side from the changeover valve 85. When the shut off valve 96 is opened and the suction pump 94 is driven, then the air and the waste ink, which exist in any one of the cap spaces S1, S2, S3 communicated with the discharge route selected by the changeover valve 85, are sucked by the suction pump 94, and the air and the waste ink are discharged from any one of the discharge holes 84*a*, 84*b*, 84*c*. The air and the waste ink are allowed to pass through the discharge route, and they are discharged to the waste ink tank 90.

The cap operating section 74 switches the capping state and the uncapping state by moving the nozzle cap 70 upwardly and downwardly. The cap operating section 74 includes: an operation rod 100 which is formed to protrude downwardly from the bottom surface of the nozzle cap 70; a coil spring 102 which urges or biases the nozzle cap 70 downwardly; a cam 104 having a substantially triangular shape which has a rack gear 104*a* disposed at the bottom portion thereof; a pinion gear 106 which is meshed with the rack gear 104*a*; and a driving motor 108 which rotates the pinion gear 106. Therefore, when the pinion gear 106 is rotated by the driving motor 108, then the cam 104 is moved in the direction perpendicular to the up-down direction, and the operation rod 100 and the nozzle cap 70 are moved upwardly or downwardly along with an inclined surface 104*b* of the cam 104.

The control unit 10F, which is provided as the "purge control unit", operates the cap operating section 74 so that the nozzle cap 70 is installed to the nozzle surface 22. After that, the sucking section 72 is operated so that the "total purge amount" is properly adjusted for each of the sizes of the ink cartridges 40*a*, 40*b*, 40*c* while switching the changeover valve 85. The term "total purge amount" herein means the total discharge amount of the ink discharged in a predetermined period of time. In this embodiment, each of the size detecting sections 46*a*, 46*b*, 46*c* is constructed to be capable of detecting the three types of the sizes of "small", "middle", and "large". Therefore, the control unit 10F judges any one of the size classes of the three types of the "small size class", the "middle size class", and the "large size class" to which the detected size belongs. In this arrangement, the control unit 10F operates the sucking section 72 so that the total purge amount R1, R2, or R3, which corresponds to the size class, can be obtained. In this embodiment, as described later on, the total purge amount R1, R2, or R3 is changed depending on the size class by changing the frequency or repetition of the operation of the sucking section 72 depending on the size class and/or by changing the purge amount per one operation.

The following assumption is now affirmed as described above. That is, the smaller the size of the ink cartridge 40*a*, 40*b*, 40*c* is, the smaller the initial volume is, and the quicker the speed of increase in viscosity of the ink is. Therefore, it is considered that the smaller the size of the ink cartridge 40*a*, 40*b*, 40*c* is, the larger the total purge amount is, which is required. Accordingly, the ink discharge apparatus 10 according to this embodiment is constructed so that the total purge amounts R1, R2, R3, which correspond to ink cartridges of the "small size class", the "middle size class", and the "large size class" respectively, satisfy the relationship of "R1>R2>R3".

As shown in FIG. 3A, it is assumed that the size detecting sections 46*a*, 46*b*, 46*c* detect that the sizes of the ink cartridges 40*a*, 40*b*, 40*c* are the "small", the "large", and the "large" respectively (i.e., in the case of this embodiment). In this case, the control unit 10F operates the sucking section 72 so that the total purge amount Ra, which relates to the ink cartridge 40*a* of the "small" size belonging to the "small size class", is R1. Simultaneously, the control unit 10F operates the sucking section 72 so that the total purge amounts Rb, Rc, which relate to the ink cartridges 40*b*, 40*c* of the "large" size belonging to the "large size class", are R3 which is smaller than R1. On the other hand, as shown in FIG. 3B, it is assumed that the size detecting sections 46*a*, 46*b*, 46*c* detect that the sizes of the ink cartridges 40*a*, 40*b*, 40*c* are the "small", the "middle", and the "large" respectively. In this case, the control unit 10F operates the sucking section 72 so that the total purge amount Ra, which relates to the ink cartridge 40*a* of the "small" size belonging to the "small size class", is R1. Simultaneously, the control unit 10F operates the sucking section 72 so that the total purge amount Rb, which relates to the ink cartridge 40*b* of the "middle" size belonging to the "middle size class", is R2 which is smaller than R1, and the total purge amount Rc, which relates to the ink cartridge 40*c* of the "large" size belonging to the "large size class", is R3 which is smaller than R2.

Figure 4A:
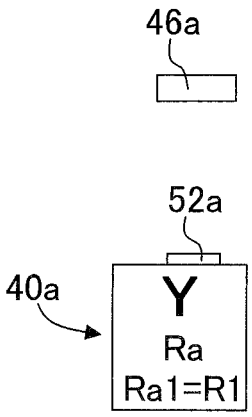
FIGS. 4A, 4B and 4C show the "total purge amount" for each of the sizes of ink cartridges (for the same color) respectively.
Figure 4B:
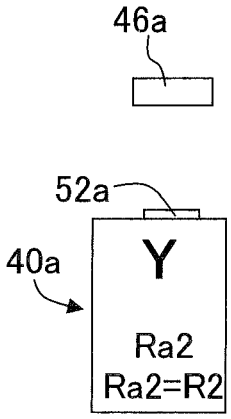
Figure 4C:
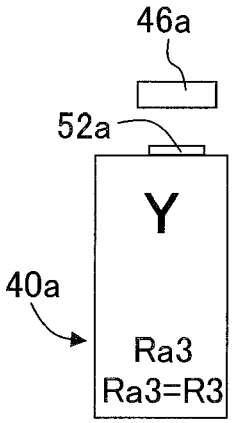

FIGS. 4A to 4C show that the total purge amounts R1, R2, R3, which correspond to the "small size class", the "middle size class", and the "large size class", satisfy the relationship of "R1>R2>R3". This relationship similarly holds in relation to the ink cartridges 40*a*, 40*b*, 40*c* of the three types irrelevant to the color of the ink. In other words, taking notice of the ink cartridge 40*a* which accommodates the ink of the yellow (Y), the control unit 10F operates the sucking section 72 so that the total purge amount Ra1 is R1 when the size detecting section 46*a* detects the "small" belonging to the "small size class", the total purge amount Ra2 is R2 when the size detecting section 46*a* detects the "middle" belonging to the "middle size class", and the total purge amount Ra3 is R3 when the size detecting section 46*a* detects the "large" belonging to the "large size class". In this procedure, for example, the frequency of the operation of the sucking section 72 and/or the purge amount per one operation is/are changed depending on the size class of the detected ink cartridge in order to realize the total purge amount described above.

For example, it is assumed that the size (for example, "large"), which is detected by any one of the size detecting sections 46*a*, 46*b*, 46*c*, belongs to the first size class (for example, the "large size class"). In this case, the control unit 10F discretely operates the sucking section 72 so that the forcible discharge amount of the ink (i.e., the "total purge amount") is decreased in a period of time in relation to the ink cartridge 40*a*, 40*b*, 40*c* corresponding to the concerning size detecting section 46*a*, 46*b*, 46*c*, as compared with when the size, which is detected by any one of the size detecting sections 46*a*, 46*b*, 46*c*, belongs to the second size class smaller than the first size class (for example, the "small size class" or the "middle size class").

Figure 5:
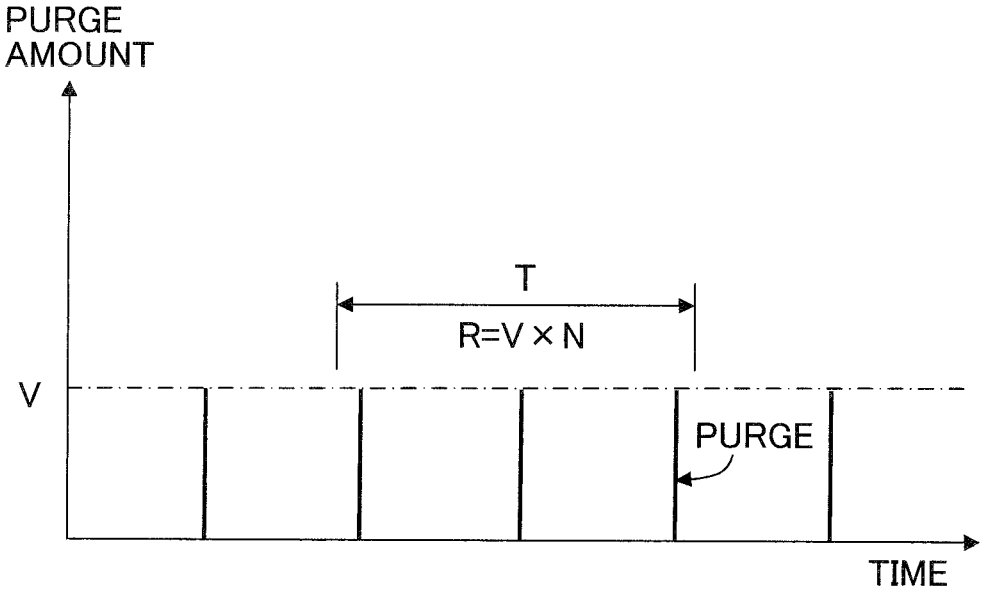
FIG. 5 shows an embodiment of the purge operation (when the purge amount is constant).

As described above, the "total purge amount" means the total discharge amount of the ink discharged in the predetermined period of time. Therefore, as shown in FIG. 5, if the discharge amount in each operation V (a purge amount V) is uniform, the actual total purge amount R can be determined in accordance with an expression of "R=V×N (N: number of times of purge operations)". If the purge amount V in each operation is nonuniform, the actual total purge amount R can be determined by adding the purge amounts V provided in respective operations. Therefore, the control unit 10F, which is provided as the "purge control unit" can allow the actual total purge amount R to coincide with the target total purge amount R1, R2, or R3 by adjusting the purge amount V or the number of times of purge operation. N.

For example, it is assumed that the total purge amount R1 is obtained if the predetermined period of time T is 200 days, the number of times of purge operation (purge frequency) N is six for every 30 days, and the purge amount per one operation is V. On this assumption, for example, the total purge amount R2 can be obtained if the purge amount V is identical and the number of times of purge operation N is five for every 40 days. Further, for example, the total purge amount R3 can be obtained if the purge amount V is identical and the number of times of purge operation N is three for every 60 days. In other words, the total purge amount can be decreased in a stepwise manner and the target total purge amounts R1, R2, R3 can be obtained by delaying or slowing the purge timing in a stepwise manner, i.e., by lowering the purge frequency in a stepwise manner. If the number of times of purge operation N in the period of time T is constant, the total purge amount can be decreased in a stepwise manner and the target total purge amounts R1, R2, R3 can be obtained by decreasing the purge amount V per one purge operation in a stepwise manner.

As shown in FIG. 2, the wipe unit 10D includes: a wipe blade 110 which is brought in contact with the nozzle surface 22 of the ink-jet head 20 to wipe out the ink adhered to the nozzle surface 22; a blade operating section 112 which allows the wipe blade 110 to be brought in contact with the nozzle surface 22 or which separates the wipe blade 110 from the nozzle surface 22; and the control unit 10F which is provided as the "wipe control section".

As shown in FIG. 1, the flashing unit 10E executes the "color mixture-preventive flashing" in which the inks, which are subjected to the counterflow into the ink-jet head 20, are forcibly discharged from the nozzles 22*a*, 22*b*, 22*c*. The flashing unit 10E includes: the plurality of driving sections 34 (FIG. 2); a flashing foam 120 which is arranged on the side opposite to the nozzle cap 70 while interposing the transport route 12 and which receives and absorbs the inks forcibly discharged from the nozzles 22*a*, 22*b*, 22*c*; and the control unit 10F which is provided as the "flashing control section".

As shown in FIG. 1, the control unit 10F controls the driving parts including: for example, the driving motor 16 of the "printing paper transport unit 10A"; the driving sections 34 (FIG. 2), the size detecting sections 46*a*, 46*b*, 46*c*, and the driving motor 66 of the "printing unit 10B"; the changeover valve 85, the suction pump 94 and the driving motor 108 (FIG. 2) of the "purge unit 10C", the blade operating section 112 of the "wipe unit 10D"; and the plurality of driving sections 34 (FIG. 2) of the "flashing unit 10E". Although not shown, the control unit 10F has, for example, a central processing unit (CPU) which executes various calculation processes and storage devices (RAM, ROM) which store various programs and data. The driving parts described above are electrically connected, for example, to the central processing unit (CPU) and the storage devices (RAM, ROM) via electric wiring lines 122*a* to 122*h* respectively.

As shown in FIG. 1, when the printing operation of the ink discharge apparatus 10 is started, then the transport rollers 14*a*, 14*b* are rotated, and thus the printing paper P is transported to the printing area Q at a predetermined timing. Further, the driving belt 64 is rotated, and thus the carriage 26 and the ink-jet head 20 are reciprocatively moved in the main scanning direction X. The driving signal is applied from the driver IC 36 to the plurality of driving sections 34 of the ink-jet head 20. Accordingly, the inks are selectively discharged from the plurality of nozzles 22*a*, 22*b*, 22*c* corresponding to the driving sections 34, and an image is printed on the printing paper P.

Figure 6:
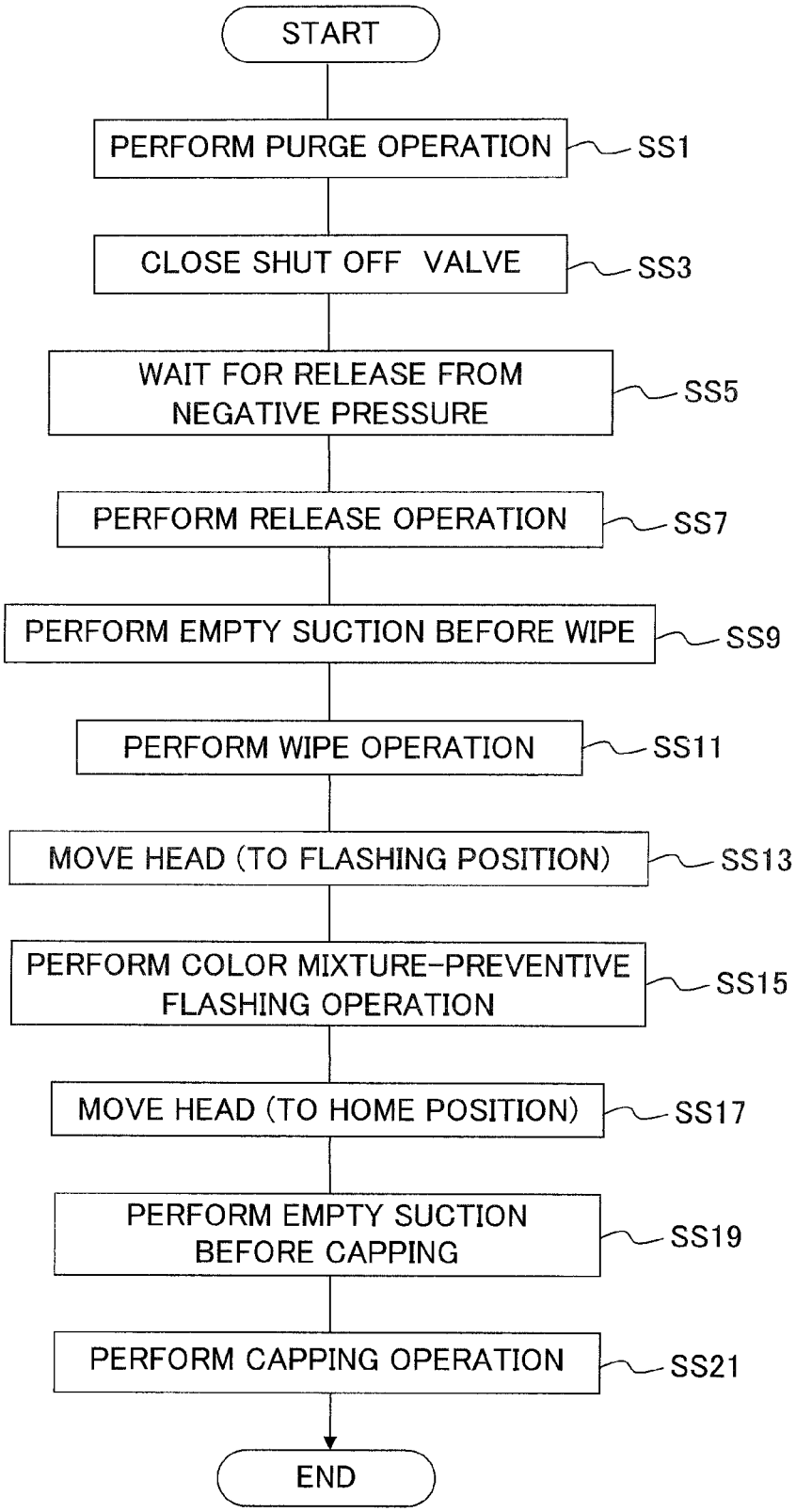
FIG. 6 shows a flow chart illustrating the "maintenance process" for the ink discharge apparatus according to the first embodiment.

When the ink discharge apparatus 10 is continuously used, then the viscosity is increased in the inks contained in the ink jet head 20 and/or the bubbles are mixed into the inks contained in the ink jet head 20. As a result, it is feared that the ink discharge malfunction may arise. Therefore, in this embodiment, the "maintenance operation" shown in FIG. 6 is executed by the control unit 10F periodically or at any arbitrary timing.

Figure 7:
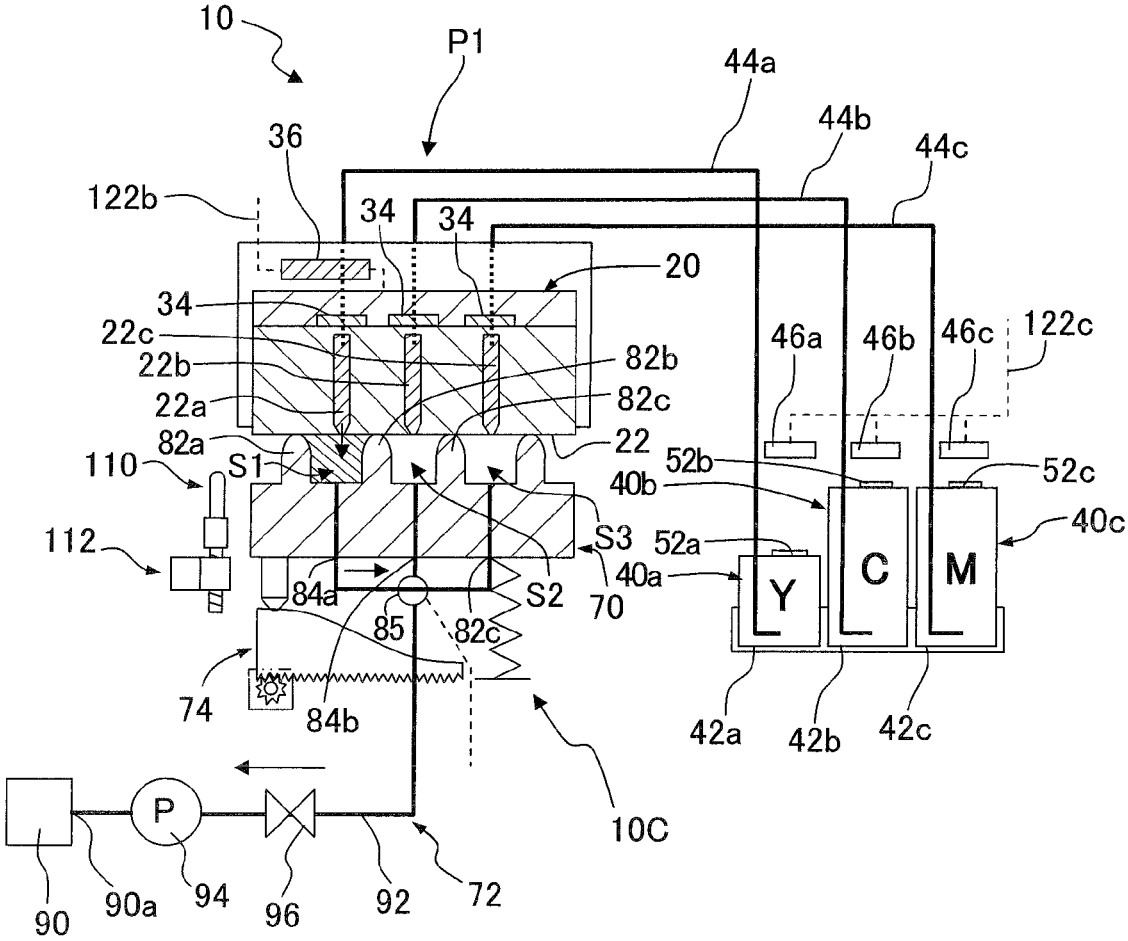
FIG. 7 shows a sectional view illustrating the "purge operation" of the ink discharge apparatus according to the first embodiment.

When the "maintenance operation" is started, the "purge operation" is firstly executed in Step SS1. That is, as shown in FIG. 7, the ink-jet head 20 is firstly moved to the "home position P1" by the scanning section 28 (FIG. 1). Subsequently, the nozzle cap 70 is moved upwardly by the cap operating section 74. Accordingly, the lips 82*a*, 82*b*, 82*c* are allowed to abut against the nozzle surface 22. After that, the discharge route, which corresponds to the nozzle 22*a*, 22*b*, or 22*c* to be subjected to the "purge operation", is selected by the changeover valve 85, and the suction pump 94 is driven in a state in which the shut off valve 96 is open. Accordingly, the negative pressure is generated in the cap space S1, S2, or S3 corresponding to the concerning discharge route. The viscosity-increased ink and the bubbles contained in the ink-jet head 20 are sucked by the negative pressure, and they are discharged from the nozzles 22*a*, 22*b*, 22*c* into the cap space S1, S2, or S3. The waste ink, which is discharged into the cap space S1, S2, or S3, is discharged to the waste ink tank 90 via the waste ink channel 92.

As shown in FIGS. 3B and 4A to 4C, it is appropriate in this embodiment that the total purge amounts R1, R2, R3, which correspond to the "small size class", the "middle size class", and the "large size class" respectively, satisfy the relationship of "R1>R2>R3". Therefore, it is not necessarily indispensable that the "purge operation" should be performed at the same timing in relation to the ink cartridges 40*a*, 40*b*, 40*c*. The "purge operation" may be performed while deviating the timing.

When the "purge operation" is completed, then the shut off valve 96 is closed in Step SS3, and this state is retained until the interior of the cap space S is released from the negative pressure in Step SS5. When a period of time elapses to such an extent that the negative pressure is released and the atmospheric pressure is provided, the "release operation" is executed in Step SS7. That is, the nozzle cap 70 is moved downwardly by the cap operating section 74, and the nozzle cap 70 is disengaged from the nozzle surface 22. Further, the empty suction (i.e., the empty suction before the wipe) is performed by the suction pump in Step SS9. The waste ink, which remains in the cap space S, is discharged to the waste ink tank 90.

The "wipe operation" is executed in Step SS11. That is, the wipe blade 110 is firstly moved upwardly by the blade operating section 112. In this situation, the wipe blade 110 is allowed to abut against the nozzle surface 22. After that, the ink-jet head 20 is moved in the main scanning direction X by the scanning section 28 (FIG. 1). In this situation, the wipe blade 110 is moved relatively with respect to the nozzle surface 22. Therefore, the inks or the like, which are adhered to the nozzle surface 22, are wiped out.

Figure 8:
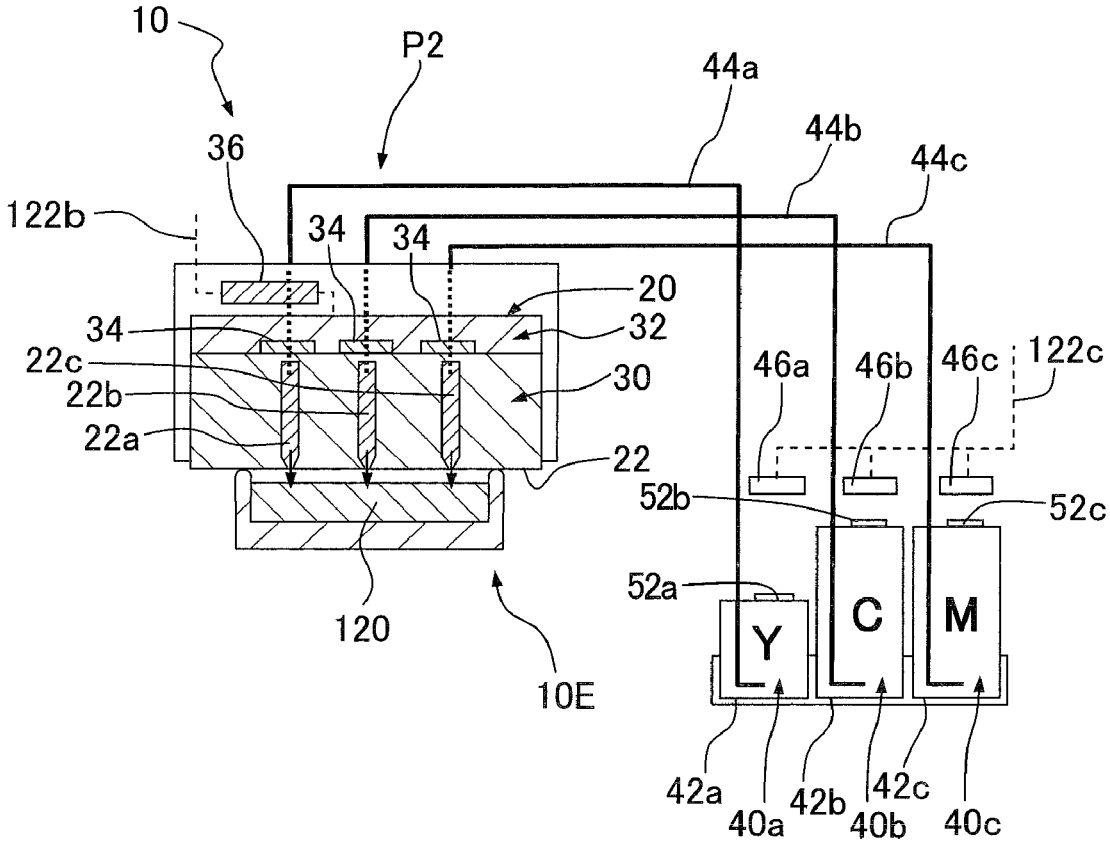
FIG. 8 shows a sectional view illustrating the "color mixture-preventive flashing operation" of the ink discharge apparatus according to the first embodiment.

In the "wipe operation", it is feared that the inks, which are adhered to the nozzle-formed surface 22, may be pushed into the nozzles 22*a*, 22*b*, 22*c* by the wipe blade 110, and the inks may be subjected to the counterflow toward the inside of the ink-jet head 20. Accordingly, in Step SS13 after the wipe operation, the ink-jet head 20 is moved to the "flashing position P2" by the scanning section 28 (FIG. 1), and the "color mixture-preventive flashing operation" is subsequently executed in Step SS15. When the "color mixture-preventive flashing operation" is started, as shown in FIG. 8, the inks are forcibly discharged from the nozzles 22*a*, 22*b*, 22*c* to the flashing foam 120 by driving the plurality of driving sections 34. The waste inks, which are subjected to the counterflow in the ink-jet head 20, are forcibly discharged from the nozzles 22*a*, 22*b*, 22*c*.

When the "color mixture-preventive flashing operation" is completed, the ink-jet head 20 is moved to the "home position P1" in Step SS17. The empty suction (i.e., the empty suction before the capping) is performed by the suction pump 94 in Step SS19. The "capping operation" is executed in Step SS21.

Second Embodiment

Figure 9:
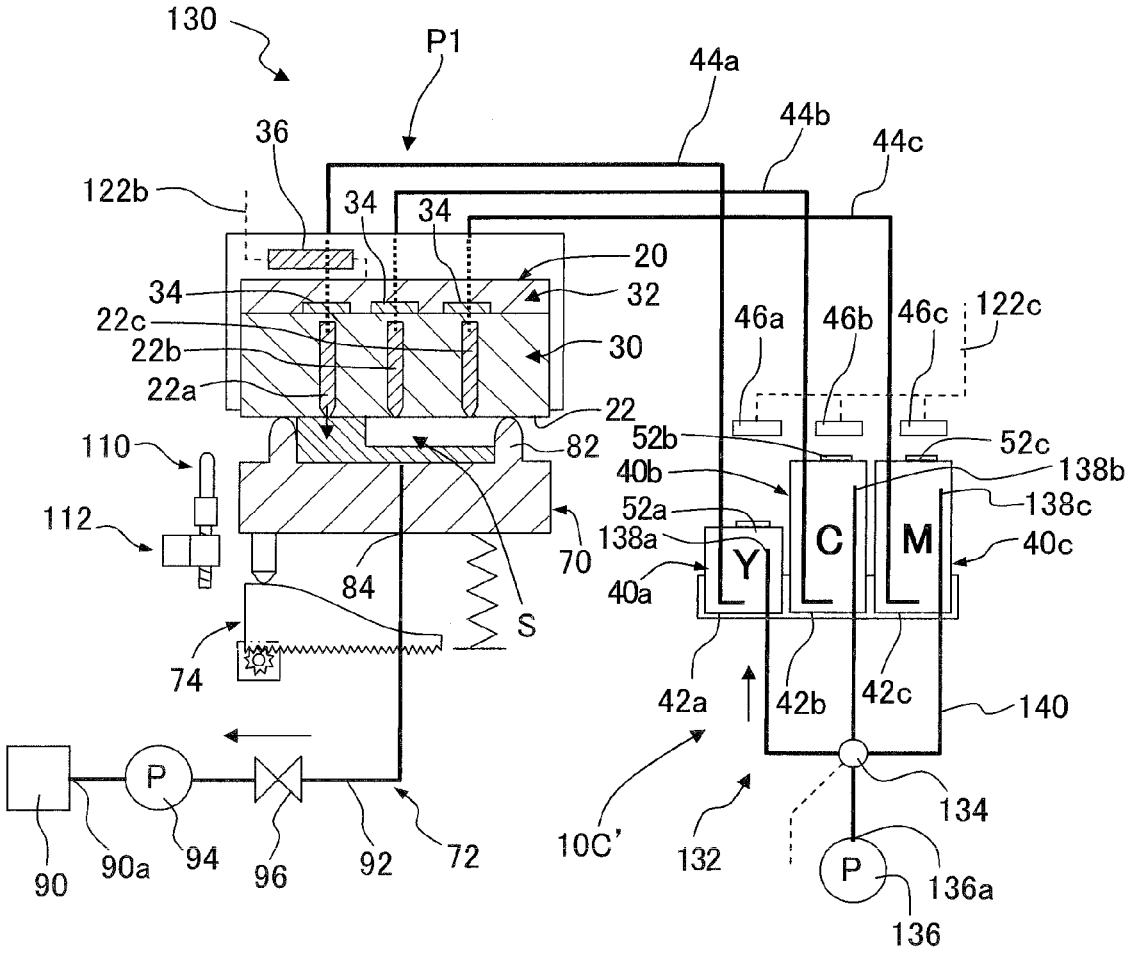
FIG. 9 shows a sectional view illustrating the "purge operation" of an ink discharge apparatus according to a second embodiment.

In an ink discharge apparatus 130 according to a second embodiment shown in FIG. 9, the purge unit 10C of the ink discharge apparatus 10 according to the first embodiment is replaced with or changed into another purge unit 10C'. The purge unit 10C' has a pressurizing section 132 which is provided as the "pressurizing mechanism" for applying the positive pressure to the interior of each of the ink cartridges 40*a*, 40*b*, 40*c*. The pressurizing section 132 includes: a changeover valve 134 which changes or switches the pressurizing route into three ways; a pressurizing pump 136; and a pressurized air channel 140 which communicates an air discharge port 136*a* of the pressurizing pump 136 with air inlets 138*a*, 138*b*, 138*c* of the ink cartridges 40*a*, 40*b*, 40*c* via the changeover valve 134.

When the "purge operation" is executed in relation to one of the ink cartridges 40*a*, 40*b*, 40*c*, the cap operating section 74 is firstly driven by the control unit 10F so that the nozzle cap 70 is installed to the nozzle surface 22. Subsequently, the changeover valve 134 is driven to select one of the pressurizing routes corresponding to the one of the ink cartridges 40*a*, 40*b*, 40*c*. After that, the pressurizing pump 136 is driven. Accordingly, the positive pressure is applied to the internal space of the one of the ink cartridges 40*a*, 40*b*, 40*c*. The positive pressure acts from the upstream side on the ink existing in the nozzles 22*a*, 22*b*, or 22*c* corresponding thereto. In other words, the positive pressure is allowed to act in the direction directed from the ink cartridge to the nozzles in the ink channel directed from the ink cartridge to the nozzles. Accordingly, the ink is discharged from the concerning nozzles 22*a*, 22*b*, or 22*c*. Also in this embodiment, the total purge amount R1, R2, or R3 is changed depending on the size class, by changing the frequency of the driving of the pressurizing pump 136 depending on the size class of the ink cartridge and/or by changing the purge amount per one operation, in the same manner as in the first embodiment.

Third Embodiment

In an ink discharge apparatus according to a third embodiment, the "purge operation" is executed by means of the flashing unit 10E described above (FIG. 8). That is, when the "purge operation" is executed in relation to one of the ink cartridges 40*a*, 40*b*, 40*c* in the ink discharge apparatus, the control unit 10F, which is provided as the "purge control unit", firstly drives the scanning section 28 (FIG. 1) so that the ink-jet head 20 is moved to the "flashing position P2". After that, the driving section 34 is driven so that the ink is discharged from the nozzles 22*a*, 22*b*, or 22*c* corresponding to the one of the ink cartridges 40*a*, 40*b*, 40*c*. In this embodiment, the "home position P1" for performing the purge process and the "flashing position P2" for performing the flashing process are not provided independently unlike the first and second embodiments. Both of the purge process and the flashing process are performed at the "flashing position P2".

In the embodiment described above, each of the cartridge attaching sections is constructed so that the ink cartridges of a plurality of sizes can be attached thereto. The size detecting section detects the sizes of the ink cartridges which are actually attached to the cartridge attaching sections. However, the present teaching is not limited thereto. For example, the sizes of the ink cartridges, which are to be attached to the respective cartridge attaching sections, may be previously determined.

Even in such a case, the present teaching is applicable when the size of the ink cartridge to be attached differs depending on the cartridge attaching sections. The present teaching is also applicable, for example, to an ink jet printer which is constructed so that only the ink cartridge having the large volume is attached for the black ink to be consumed in a large consumption amount, and only the ink cartridge having the normal or standard volume, which has the small initial volume as compared with the large volume ink cartridge, is attached for the color ink to be consumed in a relatively small consumption amount. When the sizes of the ink cartridges to be attached are fixedly determined as described above, it is not necessarily indispensable to provide the size detecting section.

The "liquid discharge apparatus" according to the foregoing embodiment is an "ink discharge apparatus" for discharging inks as "liquids" toward the printing paper. However, the present teaching is not limited thereto. The present teaching is also applicable, for example, to other "liquid discharge apparatuses" such as a "coloring liquid discharge apparatus" for discharging coloring liquids toward, for example, a filter base member or the like. When the present teaching is applied to the "coloring liquid discharge apparatus", the inks described in the foregoing explanation are to be replaced with the "coloring liquids".

What is claimed is:

1. A liquid discharge apparatus which discharges a liquid accommodated in a liquid cartridge, comprising:

a cartridge attaching section to which the liquid cartridge is attached, the liquid cartridge being one of a first liquid cartridge belonging to a first size class and a second liquid cartridge belonging to a second size class smaller than the first size class;

a liquid discharge head which is formed with a plurality of nozzles to be communicated with the liquid cartridge under a condition that the liquid cartridge is attached to the cartridge attaching section, the liquid discharge head having a plurality of driving sections which correspond to the nozzles and which causes the liquid to be discharged from the nozzles;

a purge mechanism which performs a purge operation in which the liquid is discharged forcibly from the nozzles; and a purge control unit which controls the purge mechanism to perform the purge operation so that a forcible ink discharge amount in a period of time in a case in which the first liquid cartridge belonging to the first size class is attached to the cartridge attaching section is smaller than a forcible ink discharge amount in the period of time in a case in which the second liquid cartridge belonging to the second size class is attached to the cartridge attaching section.

2. The liquid discharge apparatus according to claim 1, further comprising:

the liquid cartridge which is communicated with the nozzles under the condition that the liquid cartridge is attached to the cartridge attaching section and which accommodates the liquid therein; and a size detecting section which detects a size of the liquid cartridge attached to the cartridge attaching section, wherein the purge control unit controls the purge mechanism to perform the purge operation discretely a plurality of times, based on the size of the liquid cartridge detected by the size detecting section, so that the forcible ink discharge amount in the period of time in a case in which the size belongs to the first size class is smaller than the forcible ink discharge amount in the period of time in a case in which the size belongs to the second size class smaller than the first size class.

3. The liquid discharge apparatus according to claim 2, wherein the purge mechanism has a pressurizing mechanism which pressurizes the liquid in the liquid cartridge attached to the cartridge attaching section so that a positive pressure, which is directed from the liquid cartridge to the nozzles, is allowed to act on the liquid present in the nozzles communicated with the liquid cartridge; and the purge control unit operates the pressurizing mechanism to discharge the liquid from the nozzles.

4. The liquid discharge apparatus according to claim 3, wherein the cartridge attaching section has a plurality of individual cartridge attaching sections to each of which one of the first and second liquid cartridges is selectively attached;

the nozzles form a plurality of nozzle arrays which correspond to the individual cartridge attaching sections respectively;

the pressurizing mechanism has a pressurizing pump and a changeover valve which selectively communicates the pressurizing pump with one of the individual cartridge attaching sections; and the purge control unit performs control to drive the pressurizing pump in a state in which one of the individual cartridge attaching sections is communicated with the pressurizing pump by means of the changeover valve so that the purge mechanism performs the purge operation individually for each of the nozzle arrays.

5. The liquid discharge apparatus according to claim 2, wherein the purge mechanism has the driving sections corresponding to the nozzles communicated with the liquid cartridge; and the purge control unit operates the driving section to discharge the liquid from the nozzles.

6. The liquid discharge apparatus according to claim 2, wherein the size detecting section detects a height of the liquid cartridge as the size.

7. The liquid discharge apparatus according to claim 1, wherein the purge control unit controls the purge mechanism to perform the purge operation so that the forcible ink discharge amount in the period of time is decreased by changing a frequency in which the purge operation is performed in the period of time.

8. The liquid discharge apparatus according to claim 1, wherein the purge control unit controls the purge mechanism to perform the purge operation discretely a plurality of times in the period of time, and the purge control unit controls the purge mechanism to perform the purge operation so that the forcible ink discharge amount in the period of time is decreased by changing the ink discharge amount per one time of the purge operation.

9. The liquid discharge apparatus according to claim 1, wherein the liquid discharge head has a nozzle surface on which the nozzles are formed;

the purge mechanism includes a nozzle cap which covers the nozzle surface of the liquid discharge head, a cap operating section which attaches the nozzle cap onto the nozzle surface and which separates the nozzle cap from the nozzle surface, and a sucking section which is communicated with the nozzle cap and which sucks air contained in a space defined by the nozzle cap and the nozzle surface; and the purge control unit controls the cap operating section so that the nozzle cap is attached onto the nozzle surface, and the purge control unit thereafter controls the sucking section so that a negative pressure is generated in the space.

10. The liquid discharge apparatus according to claim 9, wherein the cartridge attaching section has a plurality of individual cartridge attaching sections to each of which one of the first and second liquid cartridges is selectively attached;

the nozzles form a plurality of nozzle arrays which correspond to the individual cartridge attaching sections respectively;

the cap has a plurality of individual cap sections which individually cover areas of the nozzle surface, respectively, each of the areas having one of the nozzle arrays formed therein corresponding to one of the individual cartridge attaching sections;

the purge mechanism further includes a changeover valve which selectively communicates the sucking section with one of the individual cap sections; and the purge control unit controls the purge mechanism to perform the purge operation individually for each of the nozzle arrays.

11. The liquid discharge apparatus according to claim 1, wherein the cartridge attaching section has a plurality of individual cartridge attaching sections to each of which one of the first and second liquid cartridges is selectively attached;

the nozzles form a plurality of nozzle arrays which correspond to the individual cartridge attaching sections respectively; and the purge control unit controls the purge mechanism to perform the purge operation individually for each of the nozzle arrays.

12. The liquid discharge apparatus according to claim 1, wherein a ratio of an area of a liquid brought in contact with a gas portion with respect to an amount of accommodated liquid in the second cartridge belonging to the second size class is greater than that in the first liquid cartridge belonging to the first size class.

13. The liquid discharge apparatus according to claim 1, wherein the plurality of nozzles are arranged at a position higher than a liquid surface of the liquid in each of the first and second liquid cartridges, an ink is accommodated in the first and second liquid cartridge as the liquid, and atmospheric air communication holes are formed in the first and second liquid cartridges, respectively, and a ratio of an opening area of the atmospheric air communication hole with respect to an amount of accommodated ink in the second liquid cartridge belonging to the second size class is greater than that in the first liquid cartridge belonging to the first size class.

14. A liquid discharge apparatus which discharges a first liquid stored in a first liquid cartridge and a second liquid stored in a second liquid cartridge, comprising:

a first cartridge attaching section to which the first liquid cartridge is attached;

a second cartridge attaching section to which the second liquid cartridge is attached;

a liquid jetting head in which a plurality of nozzles are formed, the nozzles including a plurality of first nozzles and a plurality of second nozzles which communicate with the first and second liquid cartridges respectively under a condition that the first and second liquid cartridges are attached to the first and second cartridge attaching sections, the liquid jetting head having a plurality of driving sections provided corresponding to the nozzles to cause each of the nozzles to jet one of the first and second liquids;

a purge mechanism which performs a purge operation in which the first liquid and the second liquid are discharged forcibly from the first nozzles and the second nozzles, respectively; and a purge control unit which controls the purge mechanism to perform the purge operation in which an amount of the first liquid forcibly jetted from the first nozzles in a period of time is made smaller than an amount of the second liquid forcibly jetted from the second nozzles in the period of time under a condition that a size of a contour of the first cartridge attached to the first cartridge attaching section is greater than a size of a contour of the second cartridge attached to the second cartridge attaching section.

15. The liquid discharge apparatus according to claim 14, further comprising:

the first and second liquid cartridges which accommodate the first liquid and the second liquid therein, respectively, and which are communicated with the first nozzles and the second nozzles respectively under the condition that the first and second liquid cartridges are attached to the first and second cartridge attaching sections; and first and second size detecting sections detecting sizes of contours of the first and second liquid cartridges attached to the first and second cartridge attaching sections, respectively, wherein under a condition that the size of the contour of the first cartridge detected by the first size detecting section is greater than the size of the contour of the second cartridge detected by the second size detecting section, the purge control unit controls the purge mechanism to perform the purge operation discretely a plurality of times, based on the sizes of the first and second liquid cartridges detected by the first and second size detecting sections, so that the amount of the first liquid forcibly jetted from the first nozzles is smaller than the amount of the second liquid forcibly jetted from the second nozzles.

* * * * *